United States Patent [19]

Hartley

[11] 4,214,137

[45] Jul. 22, 1980

[54] PRESSURE SWITCH WITH SNAP ELEMENT

[75] Inventor: E. Dale Hartley, Los Angeles, Calif.

[73] Assignee: Product Research and Development, Anaheim, Calif.

[21] Appl. No.: 951,110

[22] Filed: Oct. 13, 1978

[51] Int. Cl.[2] ..... H01H 35/34

[52] U.S. Cl. ..... 200/83 P; 200/81.9 R; 200/83 J; 200/83 Q

[58] Field of Search ..... 200/67 D, 67 DB, 76, 200/83 R, 83 Q, 83 P, 83 J, 81 R, 81.9 R

[56] References Cited

U.S. PATENT DOCUMENTS

| | | | |
|---|---|---|---|
| 3,240,895 | 3/1966 | Horowitz | 200/83 P |
| 3,535,480 | 10/1970 | Bahniuk | 200/83 P |
| 3,553,402 | 1/1971 | Hire | 200/83 P |
| 3,573,410 | 4/1971 | Budzich | 200/83 P |
| 3,668,347 | 6/1972 | Korsgren | 200/83 P |
| 4,081,621 | 3/1978 | Hartley | 200/83 Q |

FOREIGN PATENT DOCUMENTS

| | | | |
|---|---|---|---|
| 464406 | 4/1950 | Canada | 200/83 P |
| 607239 | 10/1960 | Canada | 200/83 P |

*Primary Examiner*—Gerald P. Tolin
*Attorney, Agent, or Firm*—Gordon L. Peterson

[57] ABSTRACT

A pressure switch comprising a housing, a first contact mounted in the housing and a support mounted in the housing in spaced relationship to the first contact. A pressure responsive member is mounted in the housing for moving a second contact into and out of engagement with the first contact and with the support. A first spring urges the pressure responsive member in opposition to the fluid pressure acting on the pressure responsive member. The pressure responsive member includes a bistable spring which carries the second contact. The bistable spring augments the first spring as the pressure responsive member moves from a low pressure position toward a high pressure position and opposes the first spring as the pressure responsive member moves from the high pressure position toward the low pressure position.

7 Claims, 5 Drawing Figures

PRESSURE SWITCH WITH SNAP ELEMENT

BACKGROUND OF THE INVENTION

A pressure switch typically includes a separate switch, such as a microswitch, and a pressure responsive section for actuating the switch. A pressure switch has a differential which enables it to close the switch in response to one pressure level and to open the switch in response to a different pressure level. Pressure switches of this kind are shown, for example, in my prior U.S. Pat. Nos. 3,651,292, 3,711,222 and 4,081,621.

Pressure switches of the kind described and claimed in my prior patents work very satisfactorily. However, each of these pressure switches employs a separate microswitch as the switching element. Unfortunately, microswitches have become increasingly expensive, and so it is desirable to eliminate the separate microswitch as a component of the pressure switch.

SUMMARY OF THE INVENTION

This invention eliminates the usual microswitch as a component of the pressure switch. In place of the microswitch, inexpensive switching elements are provided. In addition, the contacts of the switch are opened and closed very rapidly to avoid burning of the contacts, and the pressure switch can have a suitable differential. The pressure switch of this invention can be constructed very inexpensively.

The concepts of this invention can be advantageously embodied in a pressure switch which includes a housing, a first contact mounted in the housing and a second contact. Pressure responsive means exposable to fluid under pressure and movable in response thereto are provided for moving the second contact into and out of engagement with the first contact so that the first and second contacts are maintained in one of two states, i.e., engaged or disengaged. The pressure responsive means is movable from a low pressure position in which the contacts are in a first of the states to a high pressure position in which the contacts are in a second of the states. First resilient means urges the pressure responsive means in opposition to the fluid pressure.

With this invention, the pressure responsive means includes second resilient means which augments the first resilient means as the pressure responsive means moves from a low pressure position toward a high pressure position and opposes the first resilient means as the pressure responsive means moves from the high pressure position toward the low pressure position. This reversable characteristic of the second resilient means contributes to the differential of the pressure switch.

Although the second resilient means can take different forms, it can advantageously include an over-center toggle device, such as a bistable spring. By mounting the second contact on the bistable spring, the resilience of the bistable spring can be used to hold the contacts together in one position of the pressure responsive means and to hold the contacts apart in a second position of the pressure responsive means. The bistable spring also provides snap action for rapidly opening and closing of the contacts to avoid contact burn.

If the pressure responsive means were allowed to move too much beyond the center position of the bistable spring, the bistable spring would be unable to maintain the contacts closed. Accordingly, a stop is provided to limit the travel of the pressure responsive means so that adequate spring pressure will exist to maintain the contacts in the closed position.

When the contacts are engaged, the bistable spring can react against the first contact to snap the bistable spring over center to open the contact. It is similarly necessary for the bistable spring to have a support to react against in order to snap over center to move the second contact back into engagement with the first contact. The support may be nonconductive or it may be a third contact so that the second contact completes a first circuit in one position and the second circuit in the other position.

The pressure responsive means may include a diaphragm exposable to fluid under pressure and a carrier mounted for movement in the housing and engageable with and movable with the diaphragm. The bistable spring is preferably mounted on the carrier by a conductive switch bracket which forms along with the bistable spring and the first resilient means, a portion of the circuit to the contact on the bistable spring.

Electrical leads couple the pressure switch to an external circuit. The leads may be coupled to the pressure switch using standard spade connectors, and the pressure switch may advantageously include strain relief means for holding the two parts of the spade connector against separation. For example, the strain relief means may include tabs appropriately positioned to prevent axial withdrawal of one portion of the spade connector from the other portion of the spade connector.

The invention, together with further features and advantages thereof, may best be understood by reference to the following description taken in connection with the accompanying illustrative drawing.

DESCRIPTION OF THE PREFERRED EMBODIMENT

Figure 1:
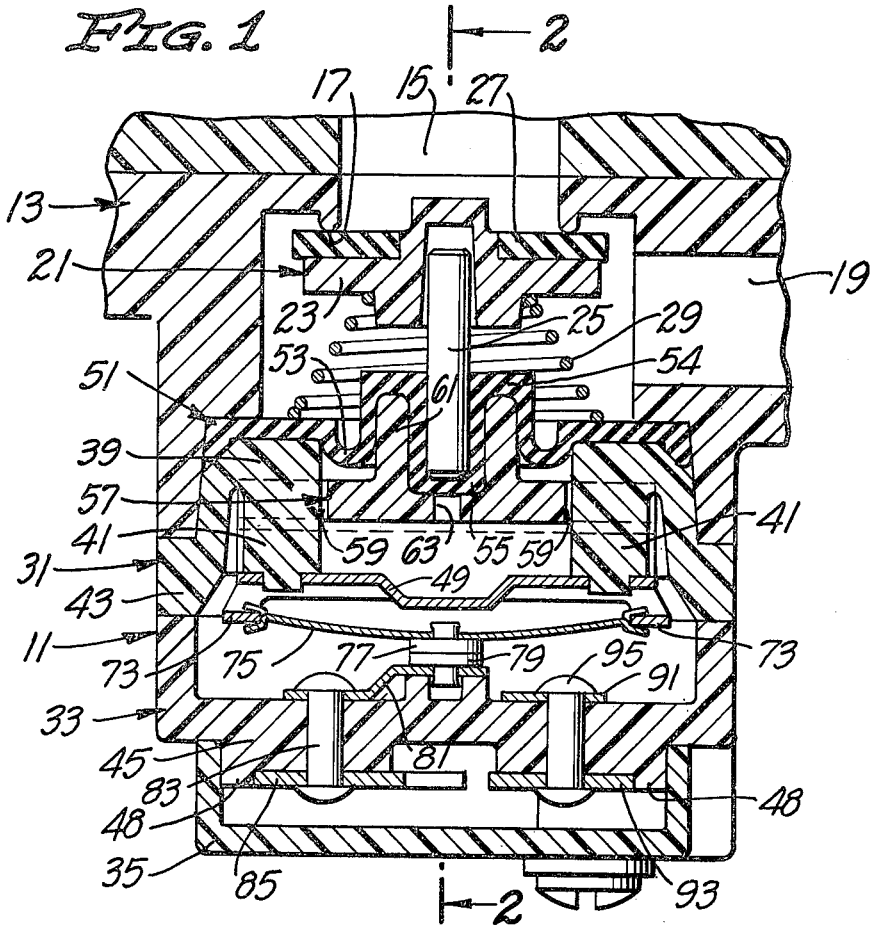
FIG. 1 is an axial sectional view through one form of pressure switch with the contacts engaged and also showing a fragment of a pump housing on which the pressure switch is mounted.

FIG. 1 shows a pressure switch 11 suitably mounted on the pump housing 13. This is merely one example of where the pressure switch 11 can be utilized. The pump housing 13 has a discharge passage 15 with an annular valve seat 17 and an outlet 19 downstream of the valve seat 17.

A check valve 21 is mounted in the discharge passage 15 and constitutes the outlet check valve for the pump. Of course, the check valve 21 can be of different configurations and located elsewhere in the system, if desired. In the embodiment illustrated, the check valve 21 includes a movable valve element 23 mounted on a stem 25, an annular seal 27 of resilient material forming a portion of the valve element, and a coil compression spring 29 for resiliently urging the valve element 23 into engagement with the valve seat 17 to close the discharge passage 15. When the pump increases the pressure upstream of the valve seat 17 sufficiently to overcome the force of the spring 29, the check valve 21 opens to allow fluid to flow to the outlet 19.

The pressure switch 11 cycles the motor (not shown) for the pump on and off in response to pressure fluctuations in the discharge passage 15 downstream of the valve seat 17. The pressure switch 11 has a housing which, in the embodiment illustrated, includes housing sections 31 and 33. A strain relief member 35 is suitably attached to the exterior of the housing section 33. The housing sections 31 and 33 are suitably joined together by bolts 37 (FIG. 2) which may also be used to attach the pressure switch 11 to the pump housing 13.

The housing sections 31 and 33 can advantageously be constructed of a nonconductive material, such as molded plastic. The housing section 31 has an internal annular flange 39 (FIGS. 1 and 2) from which a pair of posts 41 project axially, and a mounting flange 43 sandwiched between the pump housing 13 and the housing section 33. The housing section 33 has an end wall 45 and serves as a cover for the pressure switch. The housing section 33 has a pair of hollow lugs 47 projecting from the end wall 45 into the housing and a pair of terminal receivers 48.

A support in the form of a cross bar 49 is mounted on, and suitably attached to, the posts 41. The cross bar 49 in the embodiment illustrated is conductive but it is not coupled into a circuit and so is not considered a contact.

A resilient diaphragm 51 of rubber or other suitable material is clamped between the housing section 31 and the pump housing 13 with an annular region of the diaphragm serving as a seal between the housing section 31 and the pump housing. Although the diaphragm 51 can be of various different designs, in the embodiment illustrated, the diaphragm 51 includes annular folds 53 and 54 which facilitate movement of the diaphragm axially of the pressure switch 11. The diaphragm 51 also includes a tubular section 55 in which the stem 25 is mounted.

A carrier or piston 57 which can advantageously be constructed of a nonconductive material, such as molded plastic, has a pair of peripheral recesses 59 for receiving the posts 41 to mount the carrier for axial movement in the pressure switch housing. The carrier 57 also has an annular wall 61 received in the annular opening formed by the fold 54 of the diaphragm. This mounts the carrier 57 for axial movement with the central region of the diaphragm 51. The carrier 57 has a central opening 63 and hollow lugs 65 coaxial with the lugs 47, respectively.

A switch bracket 67 constructed of a suitable conductive material, such as brass, is mounted on the lugs 65. The switch bracket 67 has a flat plate portion 69 (FIG. 3), a channel-like portion 71 (FIGS. 2 and 3) with an opening 72 in the web portion of the portion 71, and a pair of mounting arms 73 (FIG. 1) at the opposite ends of the channel-like portion 71.

A bistable spring 75 in the form of an elongated resilient strip of a suitable conductive material, such as metal, is mounted on the mounting arms 73 and is movable with the switch bracket 67, the carrier 57 and the central region of the diaphragm 51. A movable switch contact 77 is mounted on and carried by a central region of the spring 75. A fixed contact 79 is mounted on a conductive switch bracket 81 which is coupled to the end wall 45 by a conductive rivet 83. A terminal 85 is coupled to the rivet 83 outside of the end wall 45.

Figure 2:
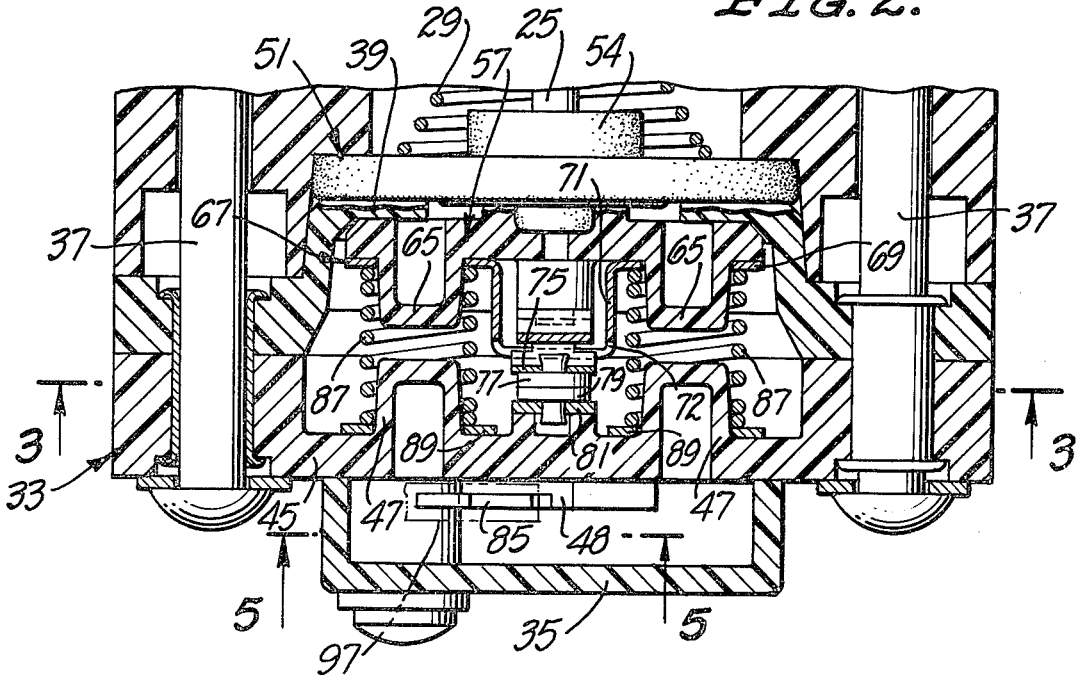
FIG. 2 is a fragmentary sectional view taken generally along line 2—2 of FIG. 1.
Figure 3:
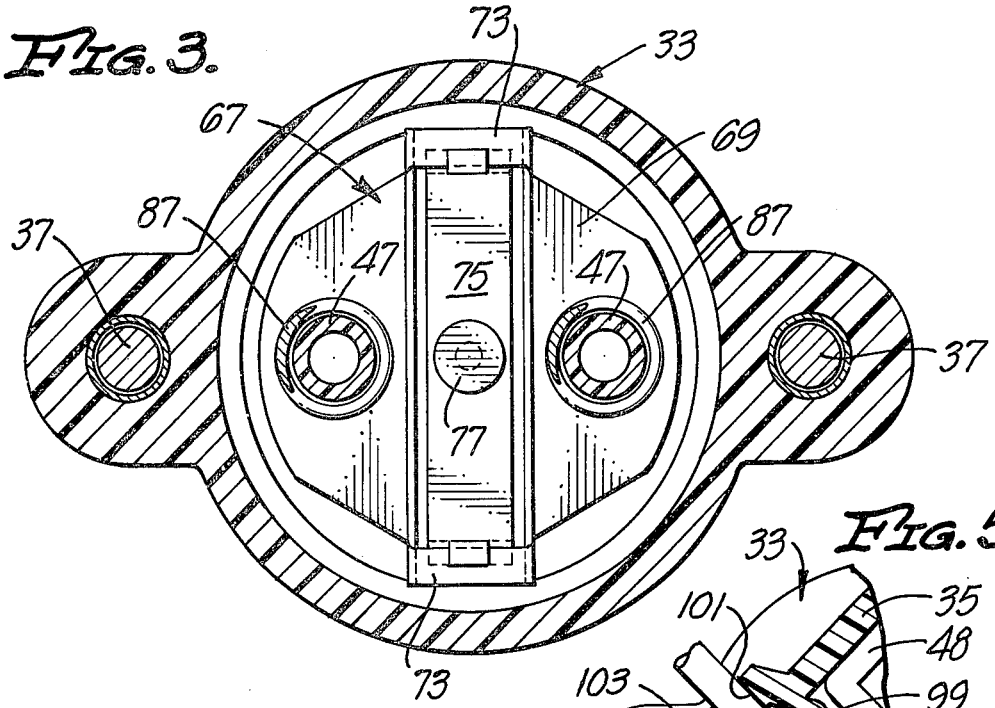
FIG. 3 is a sectional view taken generally along line 3—3 of FIG. 2.

A pair of coil compression springs 87 is guided by the lugs 47 and 65 to urge the diaphragm 51 upwardly as viewed in FIG. 1 and FIG. 2 against the force of the fluid under pressure in the discharge passage 15. The springs 87 are conductive and bear against the switch bracket 67 at one end and a contact plate 89 at the other end. The contact plate 89 has annular portions shown in FIG. 2 which surround the lugs 47, respectively, and these annular portions are integrally joined by a web 91 (FIG. 1) which is coupled to the end wall 45 and to a terminal 93 by a rivet 95. Thus, the movable contact 77 is electrically coupled to the terminal 93 by way of the bistable spring 75, the switch bracket 67, the springs 87, the contact plate 89 including the web 91 of the contact plate, and the rivet 95.

Figure 5:
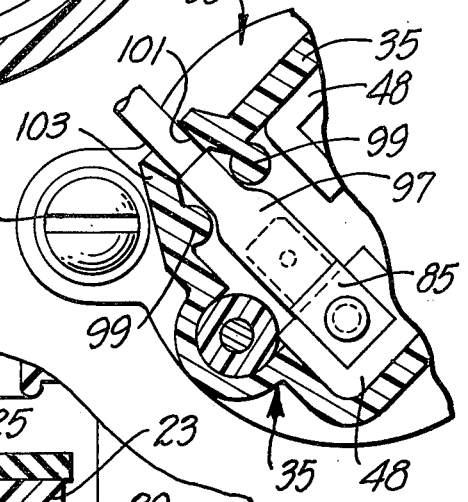
FIG. 5 is a fragmentary sectional view taken generally along line 5—5 of FIG. 2.

As shown in FIG. 5, the terminal 85 is adapted to be received in a female electrical terminal 97. Tabs 99 formed integrally with the strain relief member 35 prevent axial withdrawal of the terminal 97 from the terminal 85 through the aperture 101 in the peripheral wall 103 of the strain relief member. An identical construction retains a female connector on the terminal 93.

FIG. 1 shows the diaphragm 51 in a low pressure position and engaged to complete a circuit to energize the motor of the pump. In this position, the resilient bistable spring 75 resiliently and tightly holds the contact 77 in engagement with the fixed contact 79. With the pump operating, the pressure in the discharge passage 15 increases sufficiently to open the check valve 21 to provide water to the outlet 19. The diaphragm 51 is fluid pressure responsive and responds to the pressure of the water in the discharge passage 15 to move axially downwardly as viewed in FIG. 1. The carrier 57 and the switch bracket 67 move with the central region of the diaphragm 51. This downward motion tends to flex the bistable spring 75 and urges the contact 77 into still tighter engagement with the contact 79. This movement of the diaphragm is resiliently resisted by the springs 87 and by the bistable spring 75.

Figure 4:
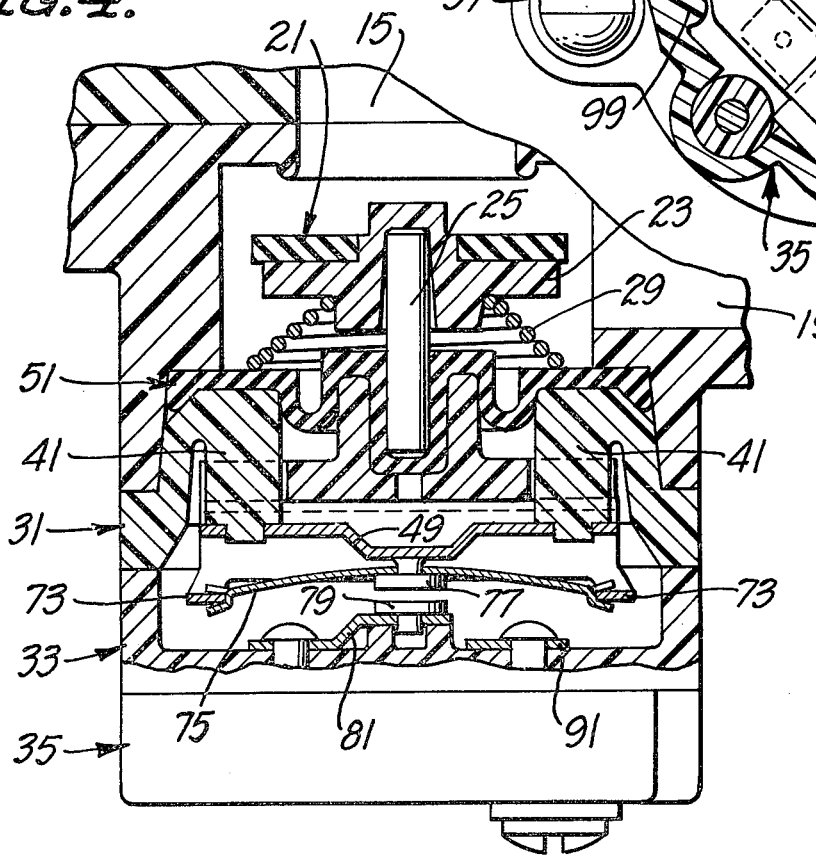
FIG. 4 is a sectional view similar to FIG. 1 with the contacts being disengaged.

As the movement of the diaphragm 51 continues, the mounting arms 73 are eventually brought to a position just below the radial plane which contains the point of attachment of the bistable spring 75 to the contact 77 whereupon the bistable spring immediately moves over center to rapidly disengage the contact 77 from the contact 79 (FIG. 4) and to move the contact 77 against the cross bar 49. This is the high pressure position of the pressure switch 11. The over-center movement of the bistable spring 75 is arrested by the contact 77 contacting the cross bar 49. This opens the circuit to the motor of the pump. After the bistable spring 75 moves over center to the position shown in FIG. 4, only the springs 87 resist further downward movement of the diaphragm 51. However, just beyond the over-center position, the lugs 65 engage the lugs 47 to prevent further downward movement of the diaphragm 51.

As water is used in the system, the pressure in the discharge passage 15 drops. The springs 87 urge the central region of the diaphragm 51 upwardly against the reducing pressure in the discharge passage 15. However, because the bistable spring 75 has snapped over center, its resilience now acts in opposition to the force of the springs 87. Consequently, the pressure must drop to a relatively low level before the mounting arms 73 are positioned to snap the bistable spring 75 over center to the low pressure position in which the contacts 77 and 79 are engaged, as shown in FIG. 2. This provides the pressure switch 11 with a differential, and the differential is the function of the spring rate of the bistable spring 75 and of the spring rates of the springs 87.

Although an exemplary embodiment of the invention has been shown and described, many changes, modifications and substitutions may be made by one having ordinary skill in the art without necessarily departing from the spirit and scope of this invention.

I claim:

1. A pressure switch comprising:
a housing;
a first contact;
means for mounting said first contact in said housing;
a second contact;
a support;
means for mounting said support in said housing with said second contact being intermediate said support and said first contact;
first means in said housing exposable to fluid under pressure and movable in a first direction in response thereto;
a carrier mounted for movement in said housing with said first means;
a bistable spring;
means for mounting the bistable spring on the carrier for movement with the carrier, said second contact being carried by said bistable spring and being movable by said bistable spring into and out of engagement with said support and said first contact;
first resilient means for urging the carrier in opposition to the fluid pressure;
said first resilient means engaging said mounting means for the bistable spring;
at least portions of said bistable spring, said mounting means for the bistable spring and the first resilient means being conductive and forming at least a portion of a circuit leading to said second contact;
said carrier having at least one lug, said mounting means for the bistable spring including a conductive switch bracket having an opening therein, said lug projecting through said opening; and
said first resilient means including a conductive coil spring engaging said switch bracket around said opening and surrounding said lug, said coil spring and said switch bracket forming portions of said circuit.

2. A pressure switch as defined in claim 1 including a terminal, means for mounting said terminal on said housing, means for electrically coupling said terminal into said circuit, and at least one tab on said housing for retaining a cooperating terminal on said housing in electrically coupled relationship to said first-mentioned terminal.

3. A pressure switch comprising:
a housing;
a first contact;
means for mounting said first contact in said housing;
a second contact;
a support;
means for mounting said support in said housing with said second contact being intermediate said support and said first contact;
first means in said housing exposable to fluid under pressure and movable in a first direction in response thereto;
a carrier mounted for movement in said housing with said first means;
a bistable spring having end portions and a central region between said end portions;
means coupled to the end portions of the bistable spring for mounting the bistable spring on the carrier for movement with the carrier;
said support mounting means mounting said support in the path of movement of the central region of the bistable spring;
said second contact being carried by the central region of said bistable spring and being movable by said bistable spring into and out of engagement with said support and said first contact; and
first resilient means for urging the carrier in opposition to the fluid pressure.

4. A pressure switch as defined in claim 3 including stops on said housing and said carrier for limiting the travel of said carrier.

5. A pressure switch as defined in claim 3 wherein said first resilient means engages said mounting means for the bistable spring, and each of said bistable spring, said mounting means for the bistable spring and the first resilient means includes conductive portions which form at least a portion of a circuit leading to said second contact.

6. A pressure switch as defined in claim 3 wherein said mounting means for the bistable spring includes a bracket coupled to the end portions of the bistable spring and drivingly coupled to the carrier.

7. A pressure switch as defined in claim 6 including a terminal mounted on said housing and circuit means for coupling said terminal to said second contact, at least a portion of said first resilient means being conductive, and said circuit means including said first resilient means.

* * * * *